US009907401B2

(12) United States Patent
Selwa

(10) Patent No.: US 9,907,401 B2
(45) Date of Patent: Mar. 6, 2018

(54) SLIDING WALL MOUNT FOR AN EASEL

(71) Applicant: Robert Allen Selwa, St. Clair Shores, MI (US)

(72) Inventor: Robert Allen Selwa, St. Clair Shores, MI (US)

( * ) Notice: Subject to any disclaimer, the term of this patent is extended or adjusted under 35 U.S.C. 154(b) by 0 days.

(21) Appl. No.: 15/460,949

(22) Filed: Mar. 16, 2017

(65) Prior Publication Data

US 2017/0273460 A1 Sep. 28, 2017

Related U.S. Application Data

(60) Provisional application No. 62/314,355, filed on Mar. 28, 2016.

(51) Int. Cl.

| | |
|---|---|
| ***A47B 97/06*** | (2006.01) |
| ***A47B 97/04*** | (2006.01) |
| ***A47B 95/00*** | (2006.01) |

(52) U.S. Cl.

CPC ..... *A47B 97/04* (2013.01); *A47B 95/008* (2013.01); *A47B 97/06* (2013.01)

(58) Field of Classification Search

USPC ..... 248/235, 243, 244, 250, 323, 324, 327; 211/94.01, 94.02

See application file for complete search history.

(56) References Cited

U.S. PATENT DOCUMENTS

| | | | | |
|---|---|---|---|---|
| 2,569,622 | A | 10/1951 | Trainor | |
| 5,007,608 | A * | 4/1991 | Carroll, Jr. | A47B 57/34 248/297.21 |
| 5,411,333 | A | 5/1995 | Hoffman | |
| 6,119,878 | A | 9/2000 | Zen | |
| 6,209,979 | B1 | 4/2001 | Fall | |
| 6,938,967 | B2 | 9/2005 | Dubon | |
| 7,048,242 | B2 * | 5/2006 | Oddsen, Jr. | F16M 11/10 248/279.1 |
| 7,448,584 | B2 | 11/2008 | Chen | |
| 8,235,479 | B2 | 8/2012 | Yu | |
| 8,474,770 | B2 | 8/2013 | Roe | |
| 9,560,786 | B2 | 1/2017 | Chen | |
| 2009/0206214 | A1 | 8/2009 | David | |
| 2013/0248670 | A1 | 9/2013 | Saez | |

* cited by examiner

*Primary Examiner* — Alfred Wujciak

(57) ABSTRACT

A wall mounting device especially made for the 360 Degree Rotating Easel so that the easel can be mounted on a wall to save space and the need for a tripod-based floor or tabletop easel. The wall mount also enables variable height adjustments of the mounted work piece by means of a sliding inner arm encased by the wall mount chassis which then attaches to the wall and the easel.

1 Claim, 10 Drawing Sheets

Front view sketch of Easel Connected to Together Sliding Wall Mount (horizontal)

Front View of the Wall Mount Chassis

End View of the Wall Mount Chassis

Front View of Inner Sliding Bar

Side View of Inner Sliding Bar

Rear View of Inner Sliding Bar

Side View of Inner Sliding Bar
And Easel Front Clamping Bar

Front View of Easel
Front Clamping Bar

Front View of Front Clamping Bar
On Inner Sliding Bar

Side View of Front Clamping Bar
On Inner Sliding Bar

Front View of Both Bars in the Mount

End View of the Inner Sliding Bar and Front Bar Clamp in the Sliding Wall Mount

Sketch of Outer Chassis with Inner Sliding Bar (front view)

Sketch of Wall Mount Chassis
Front View

Sketch of the Inner Sliding Bar
Front View

Sketch of Inner Slide Bar
(Rear View)

Sketch of Easel Front Clamping Bar
Front View

Sketch of Front Clamping Bar attached to
the Inner Sliding Bar – Front View

Front Clamping Bar
on Inner Sliding Bar
(End View Sketch)

Sketch of Front Clamping Bar
on Inner Sliding Bar
Inside Chassis (Front View)

Sketch of Front Clamping Bar
on Inner Sliding Bar
Inside Chassis (End View)

Easel Arm
(Front View)

Easel Mounted on the Sliding
Wall Mount (vertical) Front View

Front view sketch of Easel Connected to
Together Sliding Wall Mount (horizontal)

Easel and Sliding Wall Mount
End View (Sketch)

SLIDING WALL MOUNT FOR AN EASEL

CROSS-REFERENCE TO RELATED APPLICATIONS

This application claims the benefit of provisional application Ser. No. 62/314,355, filed on Mar. 28, 2016 by the present inventor.

FIELD OF THE INVENTION

This application relates to a slide assembly especially as a wall mount for artist and display easels.

BACKGROUND OF THE INVENTION—PRIOR ART

I haven't found a wall mounted sliding mechanism especially designed for artist easels in the prior art. There are similar products which are quite common that use this sliding mechanism within a casing, but are quite a bit more complicated than my embodiment. The main disadvantage is the extra costs involved in a more complicated design.

The prior art I found relating to similar sliding mounting devices are by Ann Marie Reo, Chantal Louise Pittman, Brian Scott Jalufka—Wall mounting bracket U.S. Pat. No. 8,474,770 B2 (Jul. 2, 2013); Wen-Chun Chen, Ming-Chin Huang Wall mounting monitor bracket U.S. Pat. No. 7,448,584 B2 (Nov. 11, 2008); 邓佩然—Sliding Wall-Mount chassis CN102781195 B (Apr. 1, 2015); Mike David—Wall Bracket with integrated vertical lock US20090206214 A1 (Aug. 20, 2009); Zen Vic De—Support and Attachment Wall Mount assembly CA 2245809 A1 (Feb. 27, 2000); Manuel Saez—Mechanism for Positional Adjustment of an Attached Device US 20130248670 A1 (Sep. 26, 2013); William Dubon and Ronan Stephens—US Telescoping Slide Assembly U.S. Pat. No. 6,938,967 B2 (Sep. 6, 2005); Keith A. Hoffman—Recyclable Drawer Slide U.S. Pat. No. 5,411,333 (May 2, 1995); Maxwell Scott Fall, William B. Greenwald, Carl Edward Hansen—Telescoping Slide with Quick-Mount System U.S. Pat. No. 6,209,979 B1 (Apr. 3, 2001); Mo-Ming Yu, Guang-Hua Gu, Ze-Hong Chen—Slide Assembly U.S. Pat. No. 8,235,479 B2 (Aug. 7, 2012); Shulyan Chen, Xin Su, Steven Chen—Slide Rail Assembly and Slide Rail Assembly Pair U.S. Pat. No. 9,560,786 B2 (Jan. 31, 2017); R. C. Trainor—Adjustable Support for Mirrors U.S. Pat. No. 2,569,622 (Oct. 2, 1951)—are all different in their scope, design and function from my embodiment and not especially designed for an artist easel. The art that Manual Saez teaches US 20130248670 A1 comes close to my embodiment, however I don't claim a "plurality of motion regulating devices"—specifically the gas spring shaft (60) and gas spring chamber (65) to adjust the position of the attached device. I just have pressure plates to fix the position of the easel arm. Saez's embodiment is designed for a computer display or flat screen monitor. My embodiment is especially designed to work with the 360 Degree Rotational Easel patented by the same inventor Robert A. Selwa U.S. Pat. No. 9,220,330 B, with issue date Dec. 29, 2015.

SUMMARY OF THE INVENTION

I have discovered a simple means for mounting an easel onto a wall or other accommodating surface with the additional feature of height adjustment. The setting of the desired height of the easel while attached to the sliding wall mount enables the artist to place the easel at a comfortable height for the artist, or presenter. The easel arm attaches to the wall mount assembly which is secured to a wall. This allows and enables the easel to be height adjusted. This embodiment not only allows height options for the artist or presenter for their ease, but also saves space and cost as now the tripod element is not necessary.

| DRAWINGS - REFERENCE NUMERALS | |
|---|---|
| 10 - Wall mount assembly | 11 - Wall Mount chassis |
| 12 - Drilled out hole | 13 - Pressure Plate screws |
| 16 - Insert nut | 17 - Nails |
| 18 - Pressure plate | 19 - Felt pads |
| 20 - Facing and securing bar | 22 - Inner guide bar |
| 24 - Wall mount screw | 28 - Rear mount plate |
| 30 - Recessed drill hole | 36 - Machine screw |
| 37 - Inner board | 38 - Inner sliding bar |
| 40 - Glue | 42 - Front clamping bar from easel |
| 44 - Swivel rear plate | 46 - Flat washers |
| 48 - Hex bolt | 50 - Wall or mounting surface |
| 52 - Easel Arm | 54 - Swivel rear plate |

DRAWINGS—PARTS LIST—DETAILED DESCRIPTION

10—Wall Mount Assembly—This encompasses the wall mount chassis (11) and the inner sliding bar (38) and included parts.

11—Wall Mount chassis—This consists of the unit that directly attaches to the wall or other accommodating surface. The parts of this are the facing and securing bar (20), the inner guide bar (22), and the rear mount plate (28).

12—Drilled out hole—completely drilled through hole for the insert nuts and holes to mount the device to the wall.

13—Pressure plate screws—used to fasten the pressure plates (18) to the inner sliding bar (38).

16—Insert nut—used to guide the machine screws (36) to press on the pressure plates (18) and to secure the inner sliding bar (38) to the front clamping bar (42) of the easel.

17—Nails—used to hold the pieces together for the outer chassis (20, 22, 28).

18—Pressure plate—used to secure the inner sliding bar (38) against the rear mount plate (28).

19—Felt pads—used to help glide the inner sliding bar (38) on the chassis (11).

20—Facing and securing strip—used to encase the inner sliding bar (38) into the chassis (11).

22—Inner guide bar—the bars to guide the inner sliding bar (38) in the chassis (11) and attached to the facing and securing bars (20) and the rear mount plate (28).

24—Wall mount screw—the screws that secure the wall mount chassis to the wall.

28—Rear Mount plate—the mounting surface that attaches to the wall and is the face for the inner sliding bar (38) to slide on and is directly attached to the inner guide bars (22).

30—Recessed drill hole—used on the chassis (11) for the screw to mount flush into the rear mount plate (28).

36—Machine Screws—used to secure the front clamping bar (42) of the easel assembly to the inner sliding bar (38), and the inner sliding bar (38) to the wall mount chassis (11) by way of the pressure plates (18).

37—Inner board—the wooden piece of the inner sliding bar (38).

38—Inner Sliding Bar—this is the part that slides to position the easel into place. It fits within, and is secured to the wall mount chassis (11) through pressure plates (18), and secured to the front clamping bar (42) of the easel. This includes the inner board (37) and all the parts.

40—Glue—used to hold the pieces (20, 22, 28) of the outer chassis together.

42—Front clamping bar assembly—clamping bar from the easel to mount on the inner sliding bar (38) of the wall mount assembly (10).

44—Swivel rear plate—this is directly attached to the front clamping bar (42) of the easel and interfaces with the easel arm (52).

46—Flat washers—these protect the front of the front clamping bar (42) from the machine screws (36).

48—Hex bolt—used to attach the front clamping bar (42) to the rest of the easel assembly and provides for the connecting and pivoting function.

50—Wall or another mounting surface.

52—Easel Arm of the easel assembly.

54—Swivel front plate.

| NECESSARY BUILDING TOOLS - | | |
|---|---|---|
| 1. Table saw | 2. Glue | 3. Drill and/or Drill Press |
| 4. Hex screwdriver | 5. Screw driver | 6. Disk sander |
| 7. Sandpaper | 8. Orbital sander | 9. Finish nails |
| 10. Polyurethane finish | | |

DETAILED DESCRIPTION OF THE INVENTION

Figures 1A, 1B:
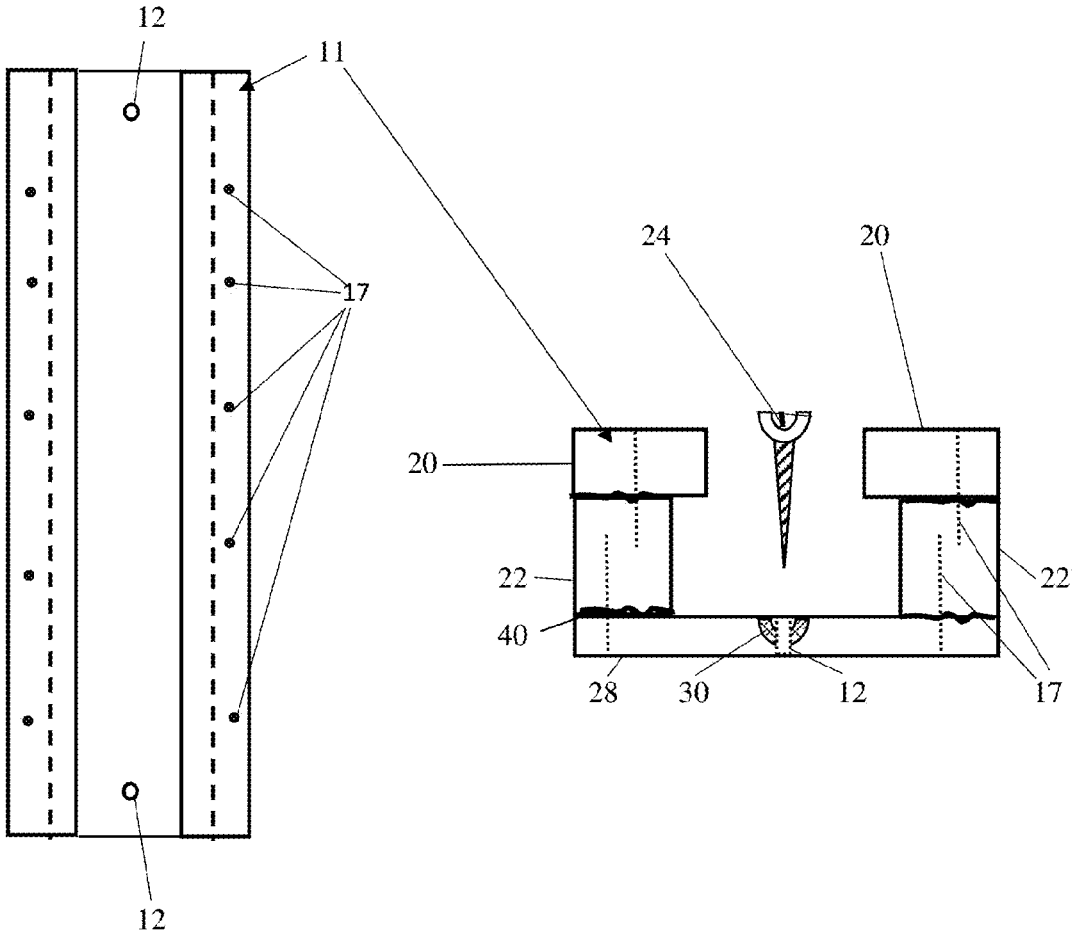
FIG. 1A—Front view of the wall mount chassis (11).
FIG. 1B—End view of the wall mount chassis (11).

Most every artist or presenter requires an easel to paint, draw, and display on, along with precious limited space in their studio. This wall mounting device to mount an easel to a mounting surface eliminates the need for a floor or tabletop easel and saves studio space. This device also allows the artist to position the height of the easel on the mounting surface (wall, door, etc. . . . ) and is especially designed as an accessory for the 360 Degree Rotational Easel, but not limited to that embodiment. The artist now has the option of having their rotating easel mount on the wall and easily adjust the height of the mounted easel for convenience and/or necessity.

The advantage of my embodiment over prior art is that this mechanism is specifically made to mate with a rotating or stationary easel and is thus designed toward this end. Sliding mechanisms are not new, nor is this encased sliding mechanism new, but using this embodiment to specifically mate and allow for a height adjustment with a rotating easel (although not limited to that easel) is novel. The canvas can now be adjusted to a height that is most comfortable for the artist, standing or sitting, and to accommodate the different sizes of their work piece. This embodiment can also be made of any suitable material—wood, plastic, metal, etc. . . . , and in any size. This embodiment is especially designed to be used with the "360 Degree Rotating Easel" patented by this inventor Robert A. Selwa U.S. Pat. No. 9,220,330 B, with issue date Dec. 29, 2015, but is not limited to this device.

I have simplified the necessary mechanisms here to their bare minimums. This embodiment is a sliding wall mount that is secured to a wall or other accommodating surface, and is also secured to an easel that attaches onto the wall mount chassis. The inner sliding bar is enclosed by the wall mount chassis, and then slid up and down inside the wall mount to vary the height adjustments of the rotating easel and is secured into position by pressure plates.

Operation—General

The wall mount (10) attaches to the wall by way of the mounting screws (24). The front clamping bar (42) of the rotating easel (or other unit) is secured onto the inner sliding bar (38) with machine screws (36). The inner sliding bar (38) is slid into the wall mount chassis (11) and then secured in place by machine screws (36) on the pressure plates (18). The rest of the easel (52) (or other device) attaches onto the locked in front clamping bar (42) by way of the hex bolt (48) on which the rotating easel arm (52) pivots. The felt pads (19) attached to the rear of the swivel front plate glides on the swivel rear plate (44) of the front clamping bar (42) for the rotating easel to function. The easel arm comprises a plurality of clamping arms for retaining the artist's canvas.

Figure 8A:
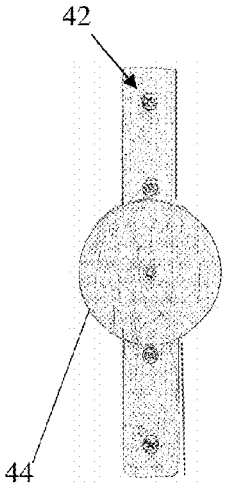
FIG. 8A—Front view sketch of Easel Front Clamping Bar (42).
Figure 8B:
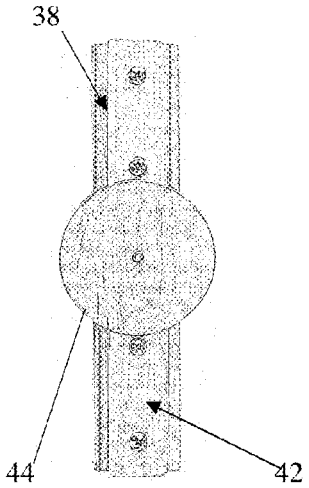
FIG. 8B—Front view sketch of the front clamping bar (42) attached to the inner sliding bar (38).
Figure 8C:
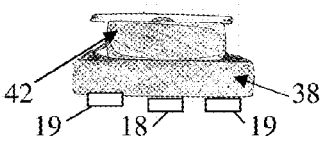
FIG. 8C—End view sketch of the front clamping bar (42) attached to the inner slide bar (38).
Figure 8D:
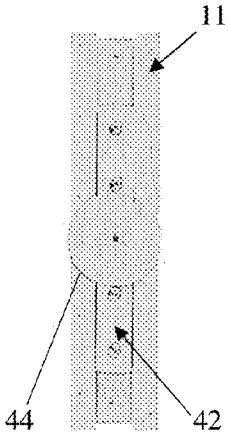
FIG. 8D—Front view sketch of the easel front clamping bar (42) connected to the inner sliding bar (38) inside the wall mount chassis (11).
Figure 8E:
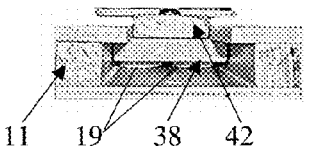
FIG. 8E—End view sketch of the easel front clamping bar (42) connected to the inner sliding bar (38) inside the wall mount chassis (11).
Figure 8F:
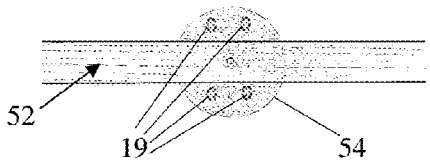
FIG. 8F—Front view sketch of the easel arm (52).
Figure 8G:
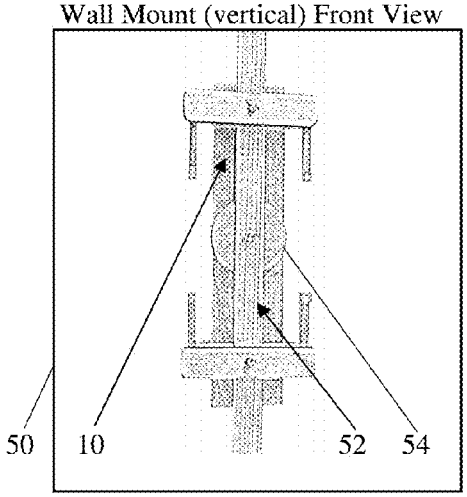
FIG. 8G—Front view sketch of the easel arm (52) mounted on the sliding wall mount assembly (10) in a vertical position.
Figure 8H:
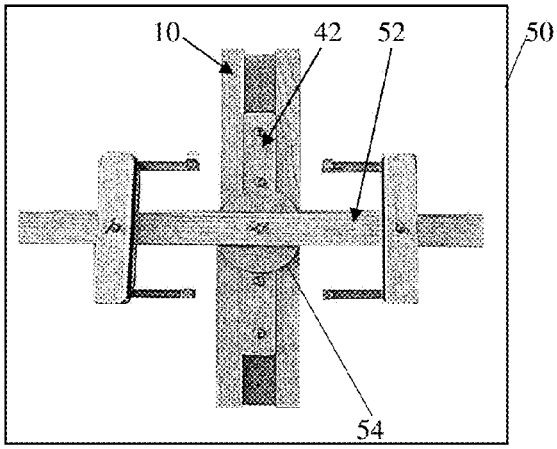
FIG. 8H—Front view sketch of the easel arm (52) mounted on the sliding wall mount assembly (10) in a horizontal position.
Figure 8J:
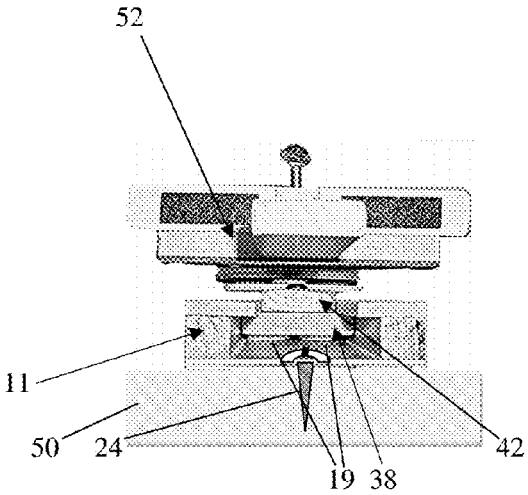
FIG. 8J—End view sketch of the easel arm (52) mounted on the sliding wall mount assembly (10) in a vertical position.

The height of the easel is adjusted by sliding the inner bar (38) up and down the wall mount chassis (11) to the desired height and secured in place by pressure using the machine screws (36) against the pressure plates (18). Pressure from the plates against the rear mount plate (28) holds the inner sliding bar (38) in place. FIGS. 8G & H show how the unit looks attached to a wall (50), or another mounting surface.

DETAILED DESCRIPTION OF THE SPECIFIC EMBODIMENTS

Figure 7A:
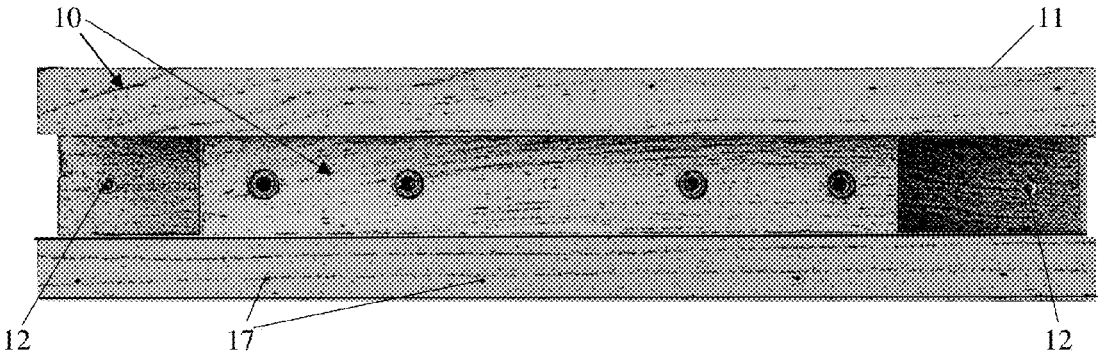
FIG. 7A—Front view sketch of the wall mount assembly (10), including the wall mount chassis (11) with the inner sliding bar (38).
Figure 7B:
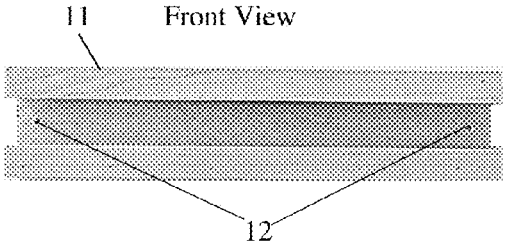
FIG. 7B—Front view sketch of the wall mount chassis (11).
Figure 7C:
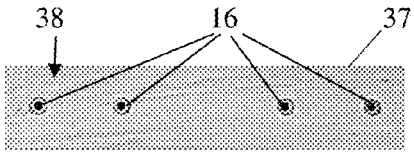
FIG. 7C—Front view sketch of the inner sliding bar (38).
Figure 7D:
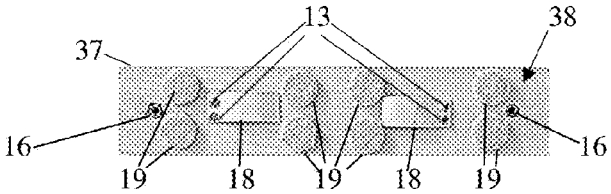
FIG. 7D—Rear view sketch of the inner sliding bar (38).

Description Of The First Embodiment—FIGS. 1A, 1B, 7B, 8D, 8E, 8G, 8H, & 8J—Wall Mount Chassis The embodiment presented in FIGS. 1A & 7B is the wall mount chassis (11) which houses (FIGS. 5, 6, 7A, 8E, 8H, 8J) the sliding inner bar (38). The chassis (11) here in FIGS. 1B & 7B consists of three parts—the rear mount plate (28), inner guide bars (22), and the facing and securing bars (20) that are secured together with glue (40) and nails (17). Holes (12) are drilled through the rear mount plate (28) and then recessed drilled (30) so a wall mount screw (24) will set flush with the topside of the wall mount chassis (11). The mounting screws (24) then screw into the mounting through the rear mount plate (28) and into the mounting surface (50) securing the wall mount chassis (11) to the mounting surface (50).

Operation of the First Embodiment—FIGS. 1A, 1B, 7B, 8D, 8E, 8G, 8H, & 8J—Wall Mount Chassis The wall mount chassis (11) is first secured by wall mount screws (24) screwed through the chassis (11) and into a mounting surface through the holes (12) shown in FIGS. 1A & 1B. This chassis (11) is then used as the guide for the sliding inner bar (38) to slide in and adjust the height of the easel.

Description of the Second Embodiment—FIGS. 2A, 2B, 2C, 3A, 4A, 4B, 5, 6, 7A, 7C, 7D, 8B, 8C, 8D, 8E, 8G, 8H, 8J—Inner Sliding Bar The inner sliding bar (38) has four holes (12) drilled though the inner board (37) that correspond to the holes in the front clamping bar (42) of the easel. Insert nuts (16) are secured into these holes (12) to allow machine screws (36) to pass through. One set of screws (36) secures the front clamping bar (42) to the inner sliding bar (38) and the second set of screws (36) secures the inner sliding bar (38) onto the chassis (11) by way of the pressure plates. See FIGS. 2A, B & C; 3A, 4A, B; 5, 6, 7D, 8C, D, E, G, H, & J.

The reverse side of the inner sliding bar (38) (FIG. 7D) has felt pads (19) attached, and pressure plates (18). The pressure plates (18) are screwed in using the appropriate screws (13) and secured into place.

Operation of the Second Embodiment—FIGS. 2A, 2B, 2C, 3A, 4A, 4B, 5, 6, 7A, 7C, 7D, 8B, 8C, 8D, 8E, 8G, 8H, 8J—Inner Sliding Bar The sliding inner bar (38) is encased and glides within the wall mount chassis (11) enclosure (see FIGS. 5, 6, 7A, 8D, E, G, H, J). The front clamping bar (42) attaches to the inner sliding bar (38) and is secured through the two outer holes (12) (FIGS. 3A, B, 4B) with the insert nuts (16) and machine screws (36) and flat washers (46) to tighten the two pieces (42 & 38) (see FIG. 3A) together.

The inner sliding bar (38) is secured onto the wall mount chassis (11) by way of the two inner holes (12) (see FIGS. 3A, B), insert nuts (16), flat washers (46), and machine screw (36). The longer machine screws (36) with flat washers (46) enter through the front clamping bar (42) and through the sliding inner bar (38) with the insert nuts (16), and then presses and bends out the pressure plates (18) until they press on the rear mounting plate (28) with sufficient pressure to secure the attached front clamping bar (42) (see FIG. 3B) of the easel arm (FIGS. 6, 8E & J) in place.

First, the wall mount chassis (11) is attached to the mounting surface. The front clamping bar (42) of the easel attaches to the inner sliding bar (38). The inner sliding bar (38) with the attached front clamping bar (42) slides into the chassis (11) and presses on the chassis' rear mounting plate (28) through the pressure plates (18) and machine screws (36), and secures the front clamping bar (42) to the wall or mounting surface (50). The sliding inner bar (38) travels up and down the chassis (11) and is secured into place by the pressure plates (18), and machine screws (36). The hex bolt (48) is recessed into the rear of the front clamping bar (42) and protrudes out the front to attach to the rotating arm (52) of the easel.

Construction of the Embodiments

To construct a wall mount chassis, cut ¼ inch plywood into a rectangle approximately 4 inches wide and 24 inches long. Next, rip a 1 inch×2 inch piece of plywood and cut into 24-inch-long pieces. Cut a 1"×2" piece of wood the same length of 24" and then rip in half. Glue and nail the pieces together as shown in FIGS. 1A & 1B. Drill small holes completely through the rear mounting plate about 1 inch from the ends for the mounting screws to fit through. Then recess the drill holes so the wall mount screw will fit flush into the rear backing plate.

Figures 2A, 2B:
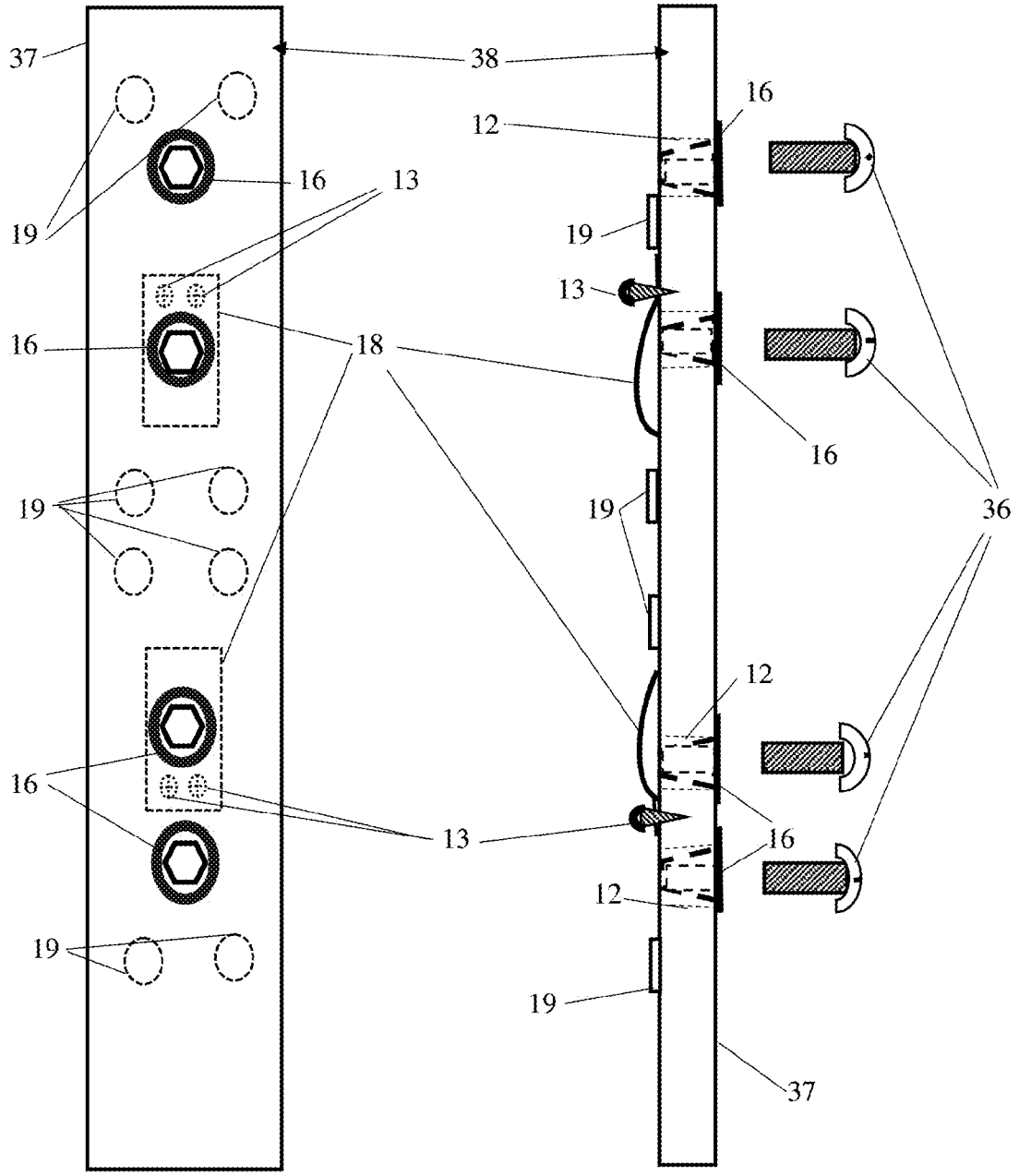
FIG. 2A—Front view of the inner sliding bar (38) with insert nuts (16), felt pads (19), and pressure plates (18).
FIG. 2B—Side view of the inner sliding bar (38) with parts.
Figure 2C:
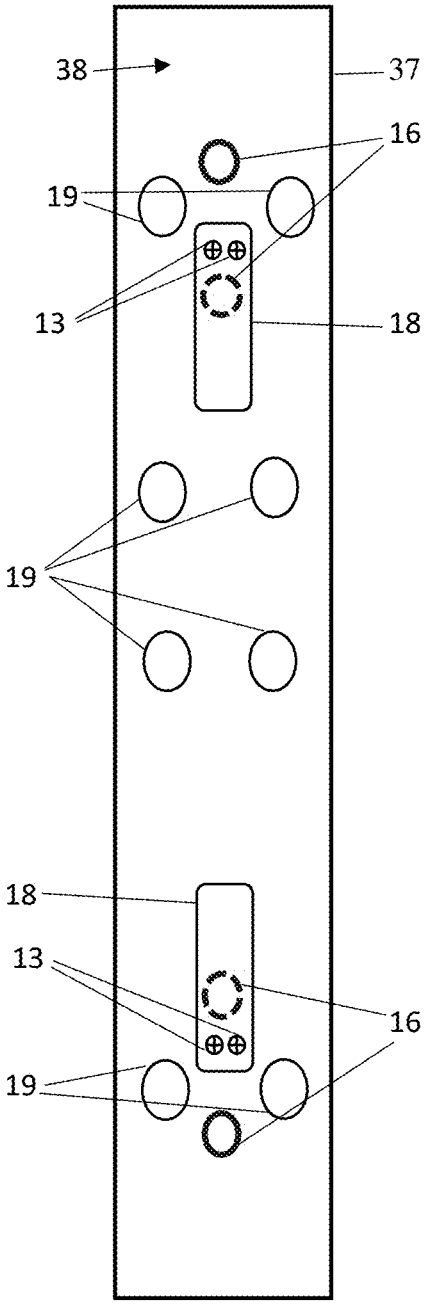
FIG. 2C—Rear view of the inner sliding bar (38) with parts.

The ⅜-inch-thick inner sliding bar (38) is cut wide enough to slip into the chassis' casing (see FIG. 2B). Next, drill four holes into the sliding inner bar to match up with the holes on the front clamping bar (42) and screw in the insert nuts (16).

Figure 3A:
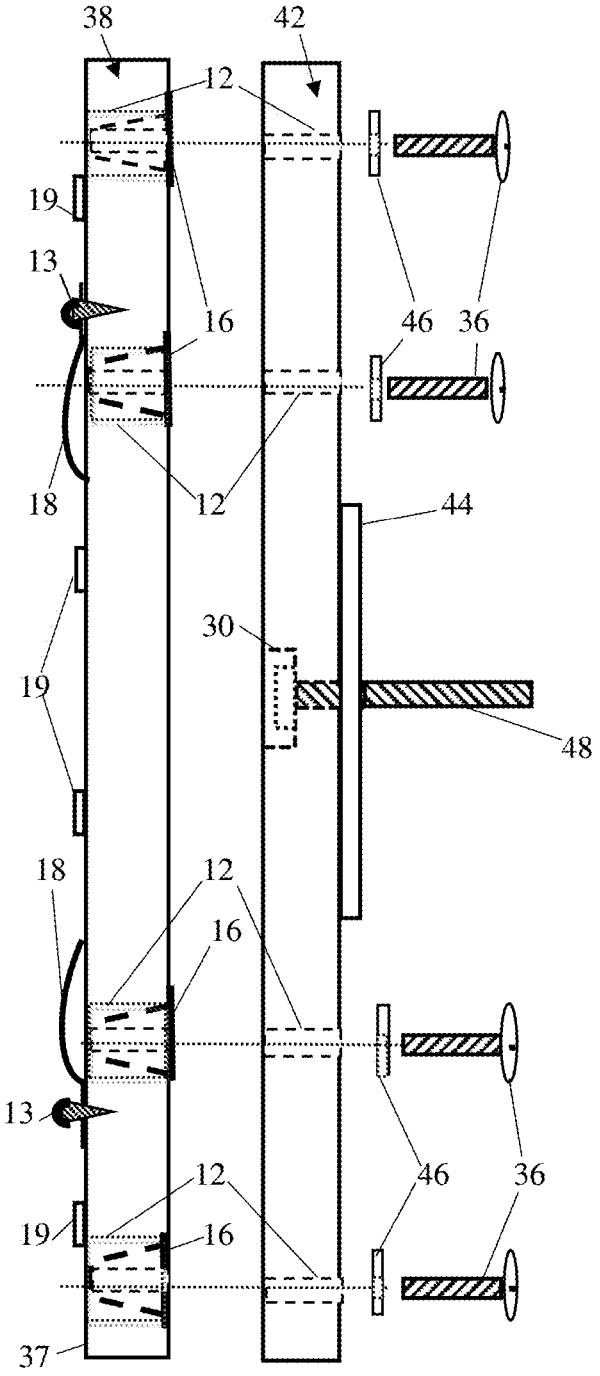
FIG. 3A—Side view of the inner sliding bar (38) with the front clamping bar (42), methods of attachment, and with protruding hex bolt (48).
Figure 3B:
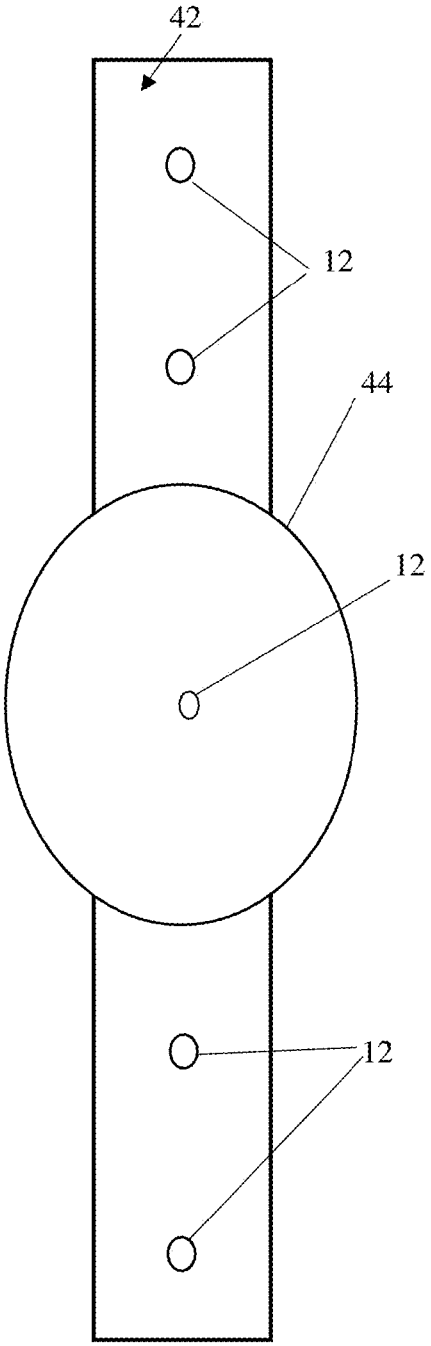
FIG. 3B—Front view of the front clamping bar (42) of the easel.
Figure 4A:
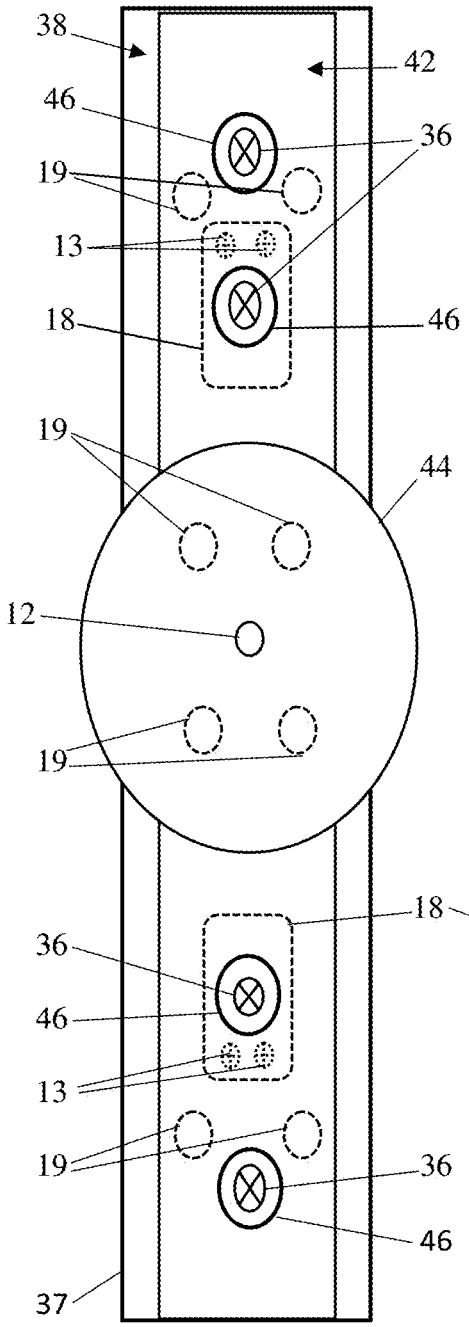
FIG. 4A—Front view of the front clamping bar (42) attached to the inner sliding bar (38).
Figure 4B:
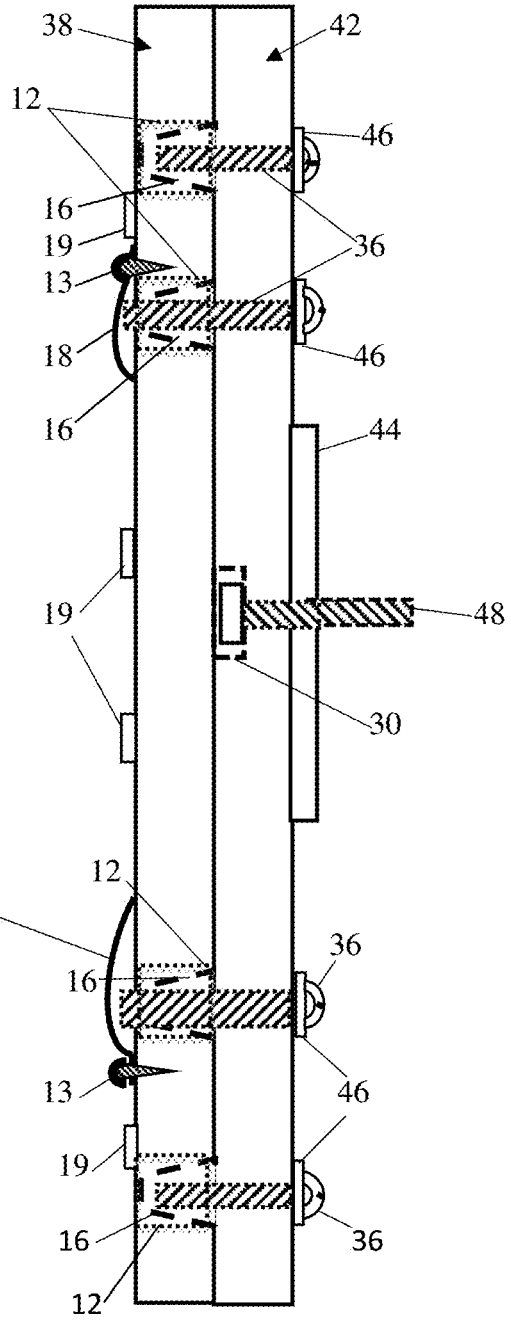
FIG. 4B—Side view of the front clamping bar (42) attached to the inner sliding bar (38) with the protruding hex bolt (48) recessed (30) into the rear of the front clamping bar (42).
Figure 5:
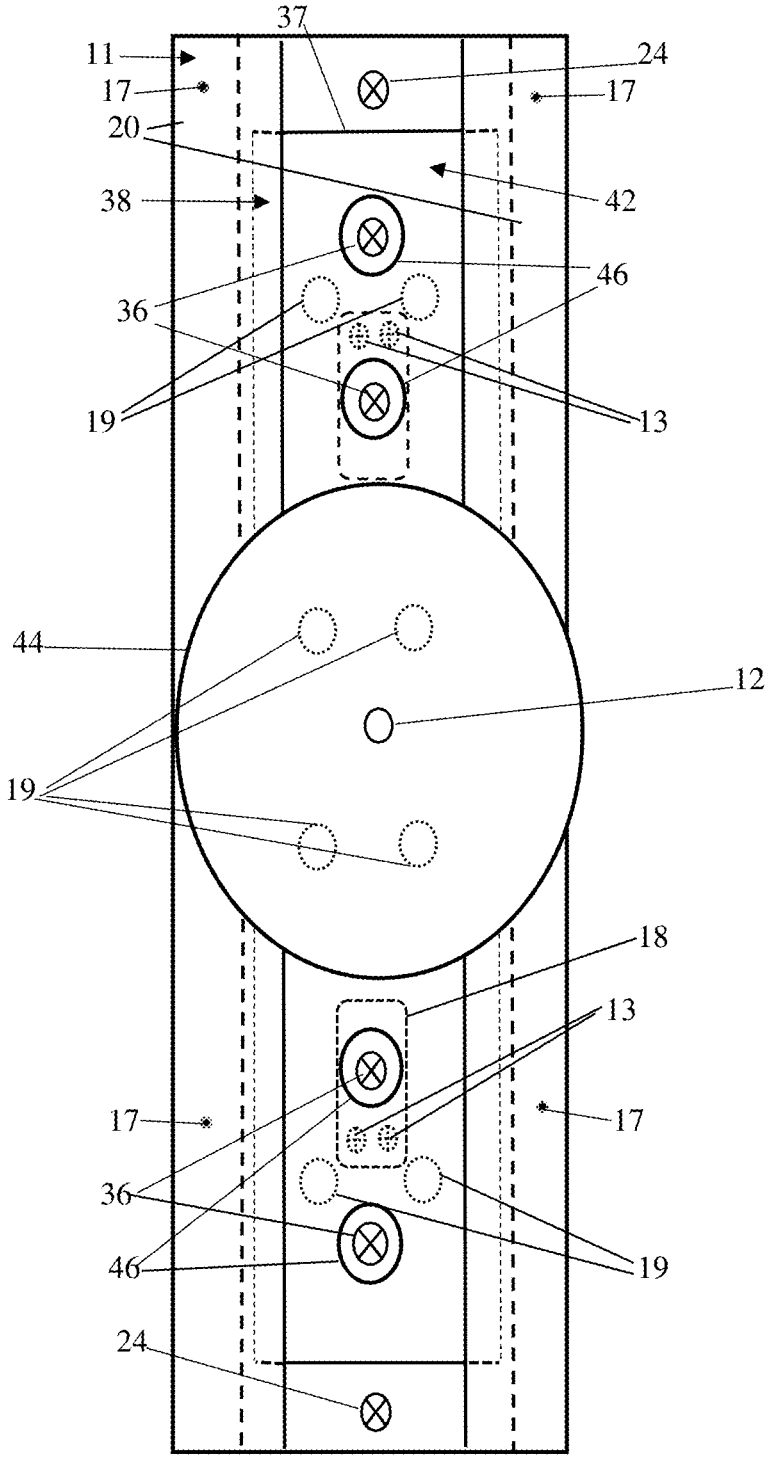
FIG. 5—Front view of the front clamping bar (42) attached to the inner sliding bar (38), and secured into the wall mount chassis (11).
Figure 6:
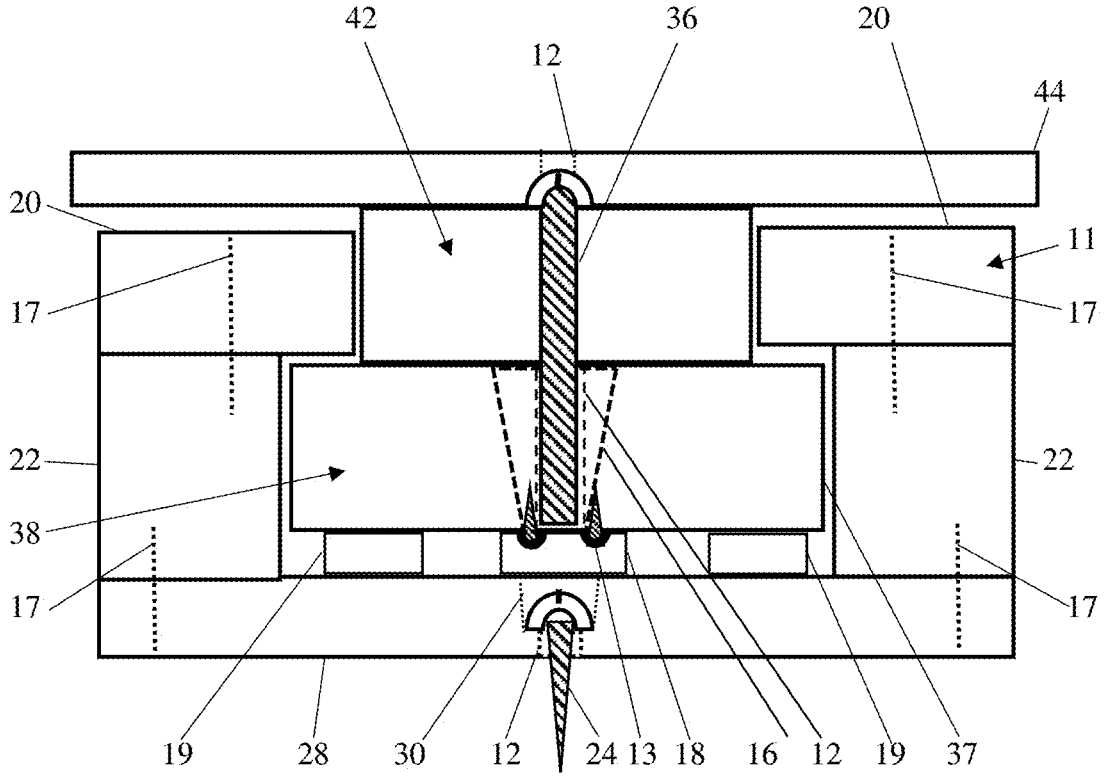
FIG. 6—End view of inner sliding bar (38) attached to the front clamping bar (42) and inserted into the wall mount chassis (11).

Apply the adhesive backed felt pads to the rear side of the inner sliding bar. Cut, or have premade strips of metal that will act as a pressure plate and drill holes as shown in FIGS. 2B & 3A into each plate and into the rear of the sliding bar. Fasten the pressure plates with the screws.

CONCLUSION, RAMIFICATION, & SCOPE

The artist, presenter, or other user can now attach their easel to a wall or mounting surface to save space and the need for a standing easel tripod. The height of the attached easel can be varied by use of the inner sliding bar that is encased in and secured onto the wall mount. This wall mount is especially designed for an easel, or other similar mated device. The artist can now lower his canvas in case he wants to paint seated, or raise the canvas to paint standing. The artist can also secure the work piece to a height that accommodates the artist and the size of the work piece.

The ramifications and scope of this embodiment are that the unit can be mounted on any surface, and at any angle, and can be made any size, with any suitable material. The design can be modified, and constructed using different manufacturing techniques (such as injection molding, 3D printers, etc. . . . ). The addition and use of a telescoping arm could also be envisioned. While designed for use with the 360 Degree Rotational Easel, other uses can be found for this embodiment.

The invention claimed is:

1. An easel wall mount for securing an artist's canvas on the wall, comprising:

a rectangular wall mount chassis defining two sides, front surface, back surface, top and bottom, comprising at least two spaced apart inner guide bars and extending in a longitudinal axis from top to the bottom of chassis and wherein one of at least two inner guide bars is mounted on one of the sides and the other at least two inner guide bars is mounted on the other side of the chassis, each of at least two inner guide bars comprising securing bar extending perpendicular from the guide bar, the securing bars are facing toward to each other, wherein the chassis, two inner guide bars and securing bars together defining a channel, wherein the back surface is mounted on the wall;

a rectangular inner sliding bar slidably mounted in the channel having a front surface and a rear surface, comprising a plurality of pressure plates having a plurality of screw holes mounted on the rear surface, the screw holes including screws for securing the pressure plates on the inner sliding bar, the inner sliding bar further comprising a plurality of felt pads mounted on the rear surface, wherein the pressure plates and the felt pads together abut the front surface of chassis in the channel to adjust the height and tension of the inner sliding bar with respect to the chassis; and a rectangular front clamping bar mounted on the inner sliding bar by a plurality of fasteners, comprising a rear swivel plate mounted on a front side of the front clamping bar with a through bolt, the front clamping bar having top, bottom, sides, front side and rear side wherein the rear includes a recessed drill hole extending through the front side of the front clamping bar and wherein the bolt extends from the rear side through and outwardly of the front side;

a front swivel plate rotatably support a rectangular easel arm, said easel arm comprises a front surface, rear surface and a plurality of spaced apart clamping arms spaced apart for retaining the canvas, wherein the front swivel plate and said rear surface of said easel arm together rotate the canvas about 360 degrees; wherein a rear surface of the front swivel plate comprising a plurality of felt pads for slidable and maintaining tension with respect to said rear swivel plate.

* * * * *